US008323069B2

(12) United States Patent
Nuttall et al.

(10) Patent No.: US 8,323,069 B2
(45) **Date of Patent: *Dec. 4, 2012**

(54) TOY VEHICLE TRACK SET WITH ROTATABLE ELEMENT

(75) Inventors: Michael Nuttall, South Pasadena, CA (US); Harold Garner, Lomita, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/896,443

(22) Filed: Oct. 1, 2010

(65) Prior Publication Data

US 2011/0021111 A1 Jan. 27, 2011

Related U.S. Application Data

(63) Continuation of application No. 11/744,607, filed on May 4, 2007, now Pat. No. 7,819,720.

(60) Provisional application No. 60/798,465, filed on May 4, 2006, provisional application No. 60/797,951, filed on May 5, 2006, provisional application No. 60/812,371, filed on Jun. 8, 2006.

(51) Int. Cl.
*A63H 18/00* (2006.01)

(52) U.S. Cl. ..... 446/444

(58) Field of Classification Search ..... 446/444–447; 238/10 R, 10 A, 10 F, 10 B; 104/35, 40
See application file for complete search history.

(56) References Cited

U.S. PATENT DOCUMENTS

| | | | | | |
|---|---|---|---|---|---|
| 434,692 | A | * | 8/1890 | Williams | 246/324 |
| 2,168,010 | A | | 8/1939 | Verplanck | |
| 2,211,220 | A | | 8/1940 | Verplanck | |
| 2,214,310 | A | | 9/1940 | Schreffler | |
| 3,206,122 | A | * | 9/1965 | Frisbie et al. | 238/10 F |
| 3,209,491 | A | * | 10/1965 | Roeper | 446/211 |
| 3,402,503 | A | * | 9/1968 | Glass et al. | 463/63 |
| 3,456,596 | A | * | 7/1969 | Cooper | 104/60 |
| 3,589,063 | A | | 6/1971 | Genin | |
| 3,621,602 | A | | 11/1971 | Barcus et al. | |
| 3,633,308 | A | * | 1/1972 | Yang | 446/444 |
| 3,735,923 | A | | 5/1973 | Brigham et al. | |
| 3,814,021 | A | * | 6/1974 | McHenry | 104/69 |
| 3,883,987 | A | * | 5/1975 | Joshi et al. | 446/487 |
| 4,068,402 | A | | 1/1978 | Tanaka | |
| 4,094,089 | A | | 6/1978 | Sano | |
| 4,146,991 | A | | 4/1979 | Sano | |
| 4,254,576 | A | | 3/1981 | Matsumoto et al. | |
| 4,355,807 | A | * | 10/1982 | Prehodka | 463/63 |

(Continued)

FOREIGN PATENT DOCUMENTS

DE 3106081 8/1982

*Primary Examiner* — Gene Kim
*Assistant Examiner* — Alyssa Hylinski
(74) *Attorney, Agent, or Firm* — Edell, Shapiro & Finnan, LLC

(57) ABSTRACT

An indexing stunt selector for a toy vehicle track set is provided. The indexing stunt selector may be disposed along a toy vehicle track and includes a first stunt element disposed in the vehicle pathway to cause a toy vehicle to perform a first stunt, where performance of a first stunt results in actuation of a first stunt trigger. The indexing stunt selector further includes a second stunt element adapted to be automatically disposed in the vehicle pathway following actuation of the first stunt trigger.

18 Claims, 2 Drawing Sheets

U.S. PATENT DOCUMENTS 4,383,688 A * 5/1983 Prehodka ..... 238/10 F
4,513,967 A 4/1985 Halford et al.
4,519,789 A * 5/1985 Halford et al. ..... 446/444
4,541,813 A * 9/1985 Ikeda ..... 446/424
4,558,867 A * 12/1985 Hippely ..... 273/412
4,564,197 A 1/1986 Lambert et al.
4,925,188 A 5/1990 McKay et al.
5,174,569 A 12/1992 Ngai
5,234,216 A * 8/1993 Ostendorff ..... 273/127 A
5,254,030 A 10/1993 Ostendorff et al.
5,440,996 A * 8/1995 Cottino ..... 104/47
5,542,668 A 8/1996 Casale et al.
5,583,298 A * 12/1996 Walsh ..... 73/852
5,586,923 A * 12/1996 Hippely et al. ..... 446/14
5,683,298 A 11/1997 Jackson
5,767,655 A 6/1998 Ostendorff et al.
5,899,789 A 5/1999 Rehkemper et al.
6,000,992 A 12/1999 Lambert
6,109,186 A 8/2000 Smith et al.
6,132,287 A 10/2000 Kuralt et al.
6,176,760 B1 1/2001 Ngai
6,241,573 B1 6/2001 Ostendorff et al.
6,358,112 B1 * 3/2002 Lambert et al. ..... 446/429
6,435,929 B1 8/2002 Halford
6,439,955 B1 8/2002 Feketo
6,508,179 B2 1/2003 Annis et al.
6,517,007 B2 2/2003 Kong
6,572,434 B2 6/2003 Man
6,676,480 B2 1/2004 Sheltman
6,692,329 B2 2/2004 Peters
6,695,668 B2 2/2004 Donahue et al.
6,733,361 B1 5/2004 Rudell
6,783,419 B1 8/2004 Paukert et al.
6,830,498 B2 12/2004 Elling
6,883,720 B2 4/2005 D'Angelo, Jr. et al.
6,908,396 B1 6/2005 Billig
6,913,508 B2 7/2005 Hornsby et al.
6,935,574 B2 8/2005 Cheng
6,951,307 B2 10/2005 Lin
6,951,497 B1 10/2005 Ngan
6,951,498 B2 10/2005 Rudell
7,025,656 B2 4/2006 Bailey
7,819,720 B2 * 10/2010 Nuttall et al. ..... 446/444
2003/0224697 A1 12/2003 Sheltman et al.
2005/0191940 A1 9/2005 Sheltman et al.

* cited by examiner

FIG. 2
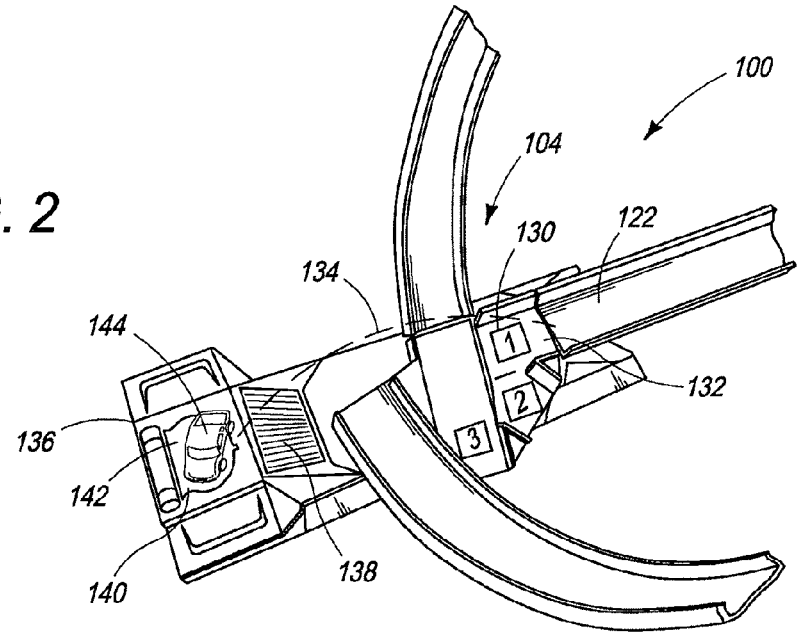
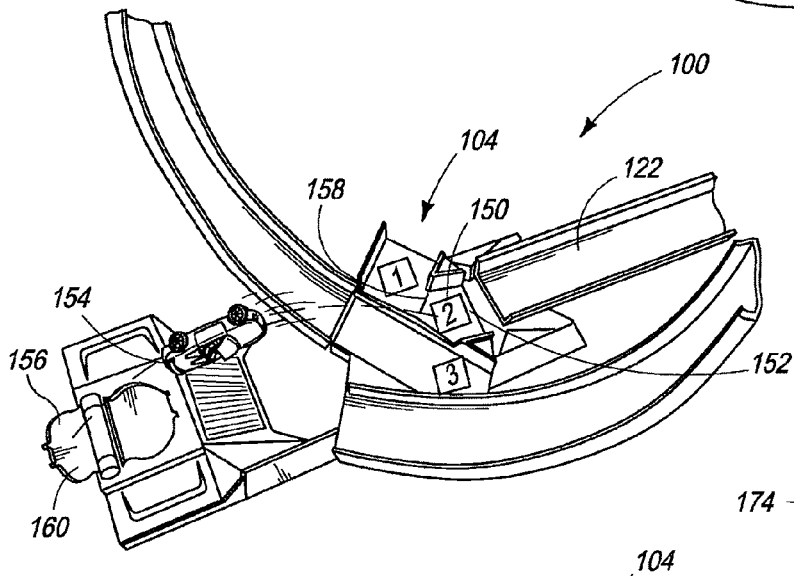
FIG. 3
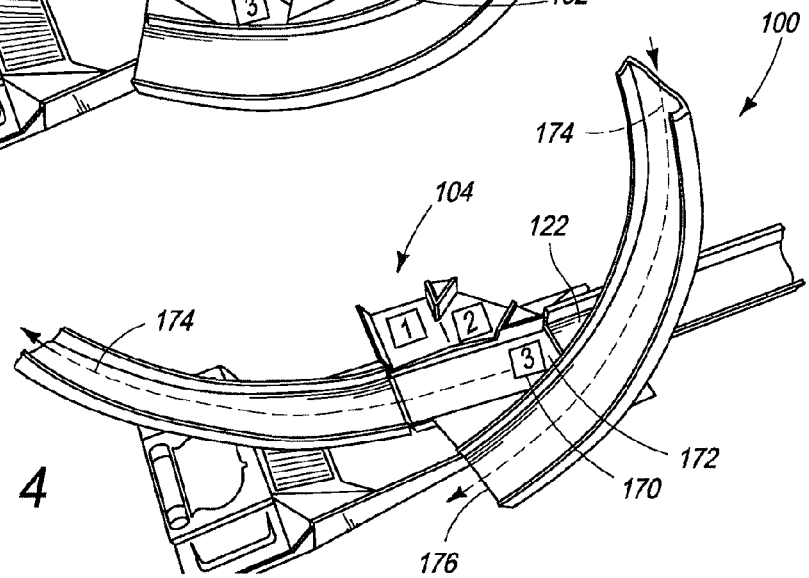
FIG. 4

TOY VEHICLE TRACK SET WITH ROTATABLE ELEMENT

CROSS REFERENCE TO RELATED APPLICATIONS

This application is a continuation of and claims priority to U.S. patent application Ser. No. 11/744,607, filed May 4, 2007, entitled "Indexing Stunt Selector for Vehicle Track Set," which claims priority to U.S. Provisional Application Ser. No. 60/798,465 filed May 4, 2006, entitled "Turntable track for movable game piece," claims priority to U.S. Provisional Application Ser. No. 60/797,951, filed May 5, 2006, entitled "Turntable track for movable game piece," and claims priority to U.S. Provisional Application Ser. No. 60/812,371 filed Jun. 8, 2006, entitled "Turntable track for movable game piece." The content of each of the four patent applications identified above is incorporated herein by reference in its entirety.

BACKGROUND OF THE INVENTION

Toy vehicle track sets have been popular for many years and generally include one or more track sections arranged to form a path around which one or more toy vehicles can travel. Toy vehicles which may be used on such track sets may be either self-powered vehicles or may receive power from an external source. In order to increase play value of the track sets, various track amusement features have been added to the track sets. For example, track features, such as stunt devices or elements, including loops, jumps, collision intersections, etc., have been included in such track sets to increase the play value of the track sets.

However, with many track sets, the vehicles run on a closed loop track moving through the same track features lap after lap. Although such track sets may have one or more stunt devices, a vehicle in the track set may perform the same stunt over and over as it travels along the track. Thus, even in track sets with more than one stunt device, the motion of the vehicle generally remains consistent for each vehicle as it travels along a specific section of the track. This repetitive nature of vehicle travel may result in loss of interest in the track set over a short period of time.

Some track sets have incorporated various manual switching mechanisms to enable a user to direct a vehicle to a select travel path. However, generally such systems require manual manipulation of the track and/or manual actuation of a switch to reroute one or more vehicles traveling on the track. Play possibilities may be limited as travel along the select paths may again become repetitive over a short period of time.

SUMMARY OF THE INVENTION

An indexing stunt selector for a toy vehicle track set is provided. The indexing stunt selector may be disposed along a toy vehicle track and includes a first stunt element disposed in the vehicle pathway to cause a toy vehicle to perform a first stunt, where performance of a first stunt results in actuation of a first stunt trigger. The indexing stunt selector further includes a second stunt element adapted to be automatically disposed in the vehicle pathway following actuation of the first stunt trigger.

BRIEF DESCRIPTION OF THE DRAWINGS

FIG. 2 shows a portion of the toy vehicle track set of FIG. 1 in a first stunt configuration.

FIG. 3 shows a portion of the toy vehicle track set of FIG. 1 in a second stunt configuration.

FIG. 4 shows a portion of the toy vehicle track set of FIG. 1 in a third stunt configuration.

WRITTEN DESCRIPTION

Figure 1:
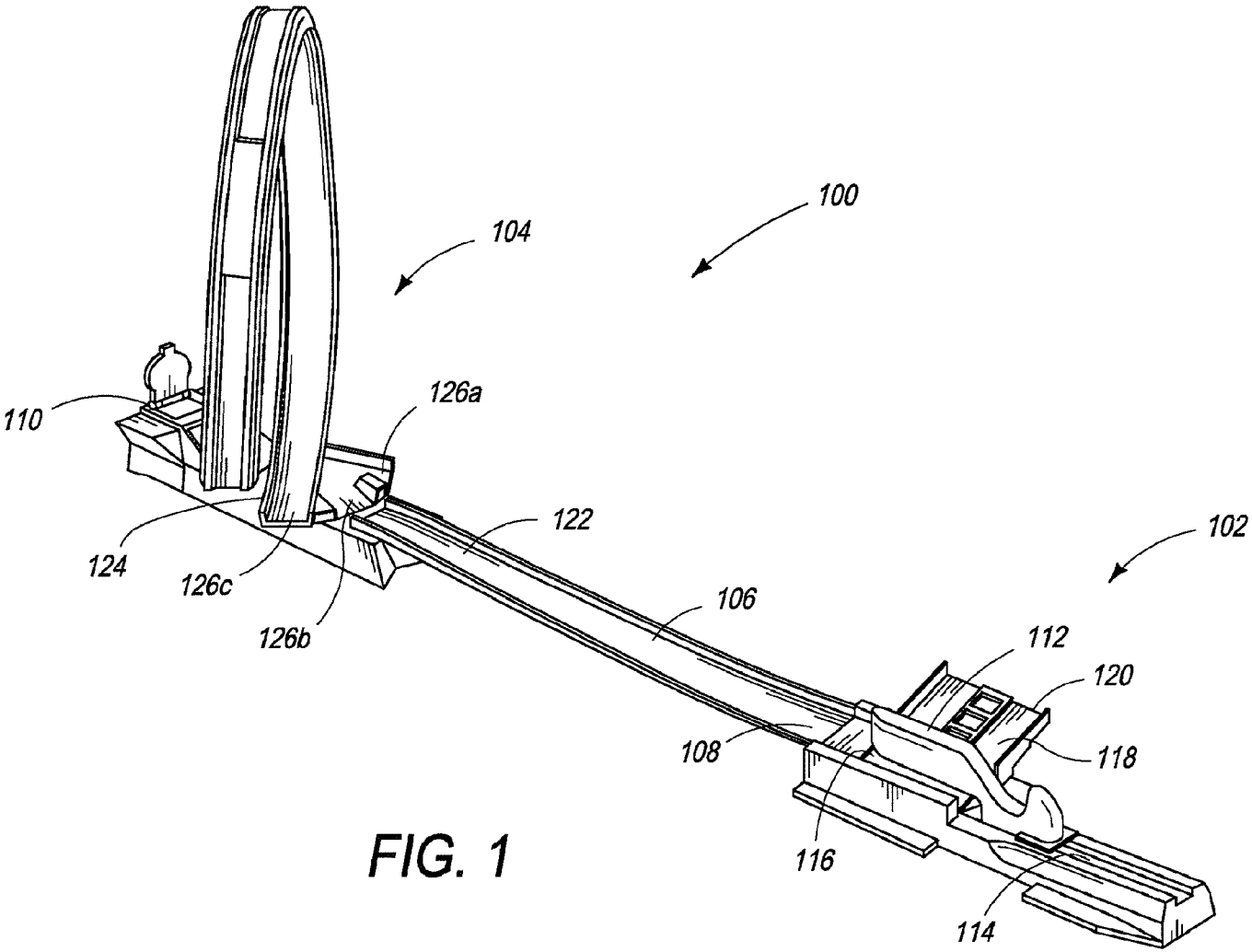
FIG. 1 shows an example toy vehicle track set including an indexing stunt selector for effecting a plurality of vehicle stunts.

FIG. 1 shows an example toy vehicle track set 100 including a launcher 102 and an indexing stunt selector 104 for providing a plurality of vehicle stunts. Track set 100 may include one or more track segments 106 on which a toy vehicle can travel. Stunt selector 104 may include one or more track segments 106.

In the illustrated embodiment, track set 100 includes a start section 108 and an end or finish section 110 such that a vehicle travels from start section 108 to end section 110. Although shown in regards to a single straight-line track, it should be understood that virtually any number of different track designs may be used without departing from the scope of this disclosure. For example, track set may be a closed loop track system, a multiple loop track system, a dual track system, etc. Further, for the sake of simplicity, track set 100 is shown with a vehicle launcher 102 and stunt selector 104, however additional track features may be incorporated into track set 100, including but not limited to additional stunt devices or elements, including loops, jumps, collision intersections, etc.

Vehicles may be put into motion along start section 108. For example, a launcher 102 may be provided to accelerate toy vehicles along the track. As such, the launcher may be configured to engage and urge a toy vehicle to travel along the track. It should be appreciated that although a launcher is described below, vehicles may be manually propelled along the track without the use of a launcher without departing from the scope of the disclosure.

Although any suitable launcher may be used, in the illustrated embodiment, a manually-triggered release launcher 102 is illustrated. A vehicle may be positioned in launch position 116 such that a launch activator 112 may slidingly engage the vehicle to propel the vehicle along the track. A user may retract the launch activator to a pre-launch position and then release (or manually move) the launch activator such that it travels along a launch track 114 to a launch position or engagement position (shown in FIG. 1). At the launch position, the launch activator may contact a vehicle positioned at the start section, and such contact may result in the vehicle being urged or propelled along the track. The launch activator may be biased to a launch position, such as by springs or any other suitable biasing mechanism such that release of the activator releases its stored potential energy. Further, in some embodiments, the launch activator may have a delayed release, such as by activation by a user of a button, or other suitable release mechanism. Further, in some embodiments, release may be controlled by a timer.

Vehicles may be positioned in launch position 116 through use of a hopper 118 which may be configured to receive multiple toy vehicles. Hopper 118 may include an inclined platform 120 to automatically position a vehicle into a launch position on the start section of the track. Launching of a first vehicle from the start section and subsequent retraction of the launch activator may release a second vehicle from the hopper to the launch position on the track. As such, multiple vehicles may be consecutively launched from the launcher 102.

Once the vehicle is released from the launcher, the vehicle may travel along the track to the indexing stunt selector 104. Each vehicle that is projected to the stunt selector may perform a stunt, and through performance of the stunt, trigger the stunt selector to index to the next stunt.

Referring back to FIG. 1, the track may include a stunt selector entry track portion 122 which provides an entrance to stunt selector 104. Stunt selector 104 may be disposed along the track such that it is in the vehicle pathway as defined by track portion 122. Stunt selector 104 may be configured to effect a plurality of vehicle stunts, including, but not limited to collision stunts, jumping stunts, flipping stunts, loop stunts, etc. Although stunt selector 104 is shown near end section 110 of track set 100, it should be appreciated that stunt selector 104 may be disposed in any suitable position along a toy vehicle track.

Stunt selector 104 may include a movable component, such as rotating element 124, which may move portions of the stunt selector relative to track portion 122. Rotating element 124 may be rotatably indexed through a plurality of pre-set rotational positions via an indexing mechanism, such as a plurality of catch/release mechanisms. Rotating element 124 may be a turntable with diverting track segments. The rotating element may be configured to rotate such that the various track segments of stunt selector 104 may be aligned with track portion 122. Depending on which track segment is aligned with track portion 122, the vehicle's path may be altered from the initial path defined by track portion 122. The track segments of stunt selector 104 may be considered stunt elements 126*a*, 126*b*, 126*c*. Each stunt element includes a vehicle entrance and a vehicle stunt pathway. Although generally described herein in regards to a rotating element, it should be appreciated that stunt selector may be any suitable moveable component such that different stunt elements may be selectively positioned and/or indexed along the vehicle pathway.

Stunt element 126 may be configured to enable a vehicle to perform a predetermined stunt. For example, stunt elements 126 may enable a vehicle to jump, twist, flip, loop, or collide with another vehicle or object. In some embodiments, audio and visual feedback may be generated corresponding to the stunt performed.

Stunt selector 104 may further include one or more stunt triggers. Stunt triggers may be disposed in the vehicle stunt pathways such that the stunt triggers may be actuated upon completion of a stunt by a toy vehicle. Actuation of the stunt triggers may result in automatic rotation of rotating element 124. It should be appreciated that the stunt triggers may be any suitable triggering mechanisms, including pressure plates, springs, mechanical switches, optical-mechanical switches, gate switches, etc. The various stunt triggers may be electronically and/or mechanically coupled with the rotating element to move the next stunt element in alignment with the track. For example, one or more gears may be coupled with the stunt trigger to move the stunt selector from a first stunt element to a second stunt element.

It should be noted that the stunt triggers may be electrically coupled to the rotating element of the stunt selector. As such, the rotating element may be linked to an electric motor which can quickly move the rotating element into position following actuation of a stunt trigger. In embodiments that utilize an electric motor, the motor can be battery powered or powered via alternating current from an outlet.

Further, it should be noted that a stunt trigger mechanism may be used as a trigger in a plurality of stunts. For example, a first stunt and a second stunt may use a common trigger mechanism to generate indexing of the stunt.

Turning now to FIGS. 2-4, the indexing stunt selector is illustrated and explained in more detail. Specifically, FIG. 2 illustrates the stunt selector in a first stunt configuration, FIG. 3 illustrates the stunt selector in a second stunt configuration, and FIG. 4 illustrates the stunt selector in a third stunt configuration. By comparing the three figures, the operation of the stunt selector may be more fully appreciated.

First, FIG. 2 illustrates a section of track 100 including track portion 122 which defines a vehicle pathway into indexing stunt selector 104. Indexing stunt selector 104 is disposed in the track such that a first stunt element 130 is positioned in the vehicle pathway to cause a toy vehicle to enter the first stunt element and perform a first stunt. Specifically, first stunt element 130 includes a vehicle entrance 132 and defines a vehicle pathway 134. As shown, first stunt element 130 is a jump element, such that a toy vehicle entering stunt element 130 with sufficient speed would be projected along vehicle pathway to platform 136. Depending on the speed of the toy vehicle, toy vehicle may contact incline 138 and continue to approach platform 136.

First stunt element 130 may be disposed in the vehicle pathway to cause a vehicle to perform a first stunt (e.g. a jump), such that performance of the first stunt results in actuation of a corresponding stunt trigger 140. For example, in the illustrated embodiment, first stunt element 130 is shown as a jump element. The first stunt element may be configured such that a successful completion of the stunt results in the toy vehicle impacting and rotating a collision target. A toy vehicle which encounters the first stunt element and jumps and impacts the corresponding collision target may actuate the first stunt trigger 140. In some embodiments, audio and visual feedback may be generated corresponding to the collision and/or successful completion of a stunt. As described above, the stunt trigger may be any suitable switch to effect rotation of the rotating element such that a second stunt element is disposed in the vehicle pathway.

As an example, first stunt trigger may be a pressure release plate 142. The pressure release plate 142 may be adapted to receive a second toy vehicle 144. The second vehicle may be considered a collision target for the first stunt element. A toy vehicle which enters the first stunt element may travel along a vehicle stunt pathway to the collision target, second toy vehicle 144. The impact into the second toy vehicle may result in the second toy vehicle being pushed from the platform, thereby releasing the pressure release plate 142. Release of the pressure release plate 142 actuates the stunt selector to index to the second stunt element. In one example, pressure release plate 142 and trigger 110 may be coupled in a common trigger mechanism.

In addition, release of pressure release plate 142 may also trigger positioning of the second stunt trigger. For example, upon release of the pressure release plate, the flame graphic (indicated at 160 in FIG. 3), may pop up from the platform as a collision target for the second stunt. The stunt selector is now set for a user to attempt to perform the second stunt.

FIG. 3 illustrates the stunt selector 104 with a second stunt element 150 positioned in the vehicle pathway to cause a toy vehicle to enter the second stunt element and perform a second stunt. Specifically, second stunt element 150 includes a vehicle entrance 152 and defines a vehicle pathway 154. As shown, second stunt element 150 is a jump and flip element, such that a toy vehicle entering stunt element 150 with sufficient speed would be projected along vehicle pathway 154 performing one or both a jump stunt and a flip stunt.

Second stunt element 150 may be disposed in the vehicle pathway to cause a vehicle to perform the second stunt such that performance of the second stunt results in actuation of a corresponding stunt trigger 156. For example, in the illustrated embodiment, second stunt element 150 is shown as a jump and flip element. The vehicle may travel from track portion 122 to the vehicle entrance 152 of second stunt element 150. A ridge or diagonal cut-off 158 may be provided on the jump to induce the toy vehicle to flip and/or rotate. The second stunt element may be configured such that a successful completion of the stunt results in the toy vehicle impacting a collision target. A toy vehicle which encounters the second stunt element and impacts the corresponding collision target may actuate the second stunt trigger 156. As described above, the stunt trigger may be any suitable switch to effect rotation of the rotating element such that a third stunt element is disposed in the vehicle pathway.

As an example, second stunt trigger may be a flag or flame graphic 160. For example, the second stunt element may project a vehicle through a flexible spring loaded flame graphic. The graphic may simulate a car jumping into a flame or fire. The impact into the flame graphic 160 may actuate the stunt selector to index to the third stunt element.

FIG. 4 illustrates the stunt selector 104 with a third stunt element 170 positioned in the vehicle pathway to cause a toy vehicle to enter the third stunt element and perform a third stunt. Specifically, third stunt element 170 includes a vehicle entrance 172 and defines a vehicle pathway 174. As shown, third stunt element 170 is a loop element, such that a toy vehicle entering stunt element 170 with sufficient speed would be projected along vehicle pathway 174 traveling along the track, upside down in a loop formation and exiting at vehicle exit 176. In some embodiments, additional toy vehicles may be positioned or piled up at vehicle exit 176 such that a third vehicle which performs the third stunt can collide or crash with cars upon exiting the third stunt element.

The stunt selector may increase play interest with the track set. Further, the indexing stunt selector and the challenge to perform the stunts consecutively may engage a player's attention and engage the player in longer play with the track set. For example, a player may attempt to complete all three stunts using only three vehicles. Moreover, the stunt selector may enable players to compete based on completion of the various stunt elements. For example, during game play, players may score points based on interaction of the car with the stunt selector. In some versions of the game, players may gain points by successfully completing the various stunts in order.

It should be appreciated that the stunt selector described herein includes three stunt elements. However, the disclosure is not intended to be so limiting and stunt selectors having more or less stunt elements are considered part of this disclosure. Thus, the stunt selector may have two, three, four, five or more stunt elements. Further, one or more stunt elements may use the same stunt trigger to index to the next stunt element. Moreover, although described in regards to movement to consecutive stunt elements, in some embodiments, stunt triggers may be configured to enable positioning of non-consecutive stunt elements along the vehicle pathway.

The track set may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, or the like.

While the present invention has been described in terms of specific embodiments, it should be appreciated that the spirit and scope of the invention is not limited to those embodiments. The scope of the invention is instead indicated by the appended claims. All subject matter which comes within the meaning and range of equivalency of the claims is to be embraced within the scope of the claims.

What is claimed is:

1. A toy vehicle track set, comprising:

a track portion; and a selector mounted for rotation relative to the track portion, the selector being movable between a first position and a second position relative to the track portion, the selector including:

a first stunt element including a first entrance, the first stunt element being movable relative to the track portion aligned with the track portion when the selector is in its first position, and offset from the track portion when the selector is in its second position, the first entrance causing a toy vehicle to travel a first path; and a second stunt element including a second entrance, the second stunt element being movable relative to the track portion, offset from the track portion when the selector is in its first position, and aligned with the track portion when the selector is in its second position, the second entrance being proximate to the first entrance, the second entrance causing a toy vehicle to travel a second path, wherein one of the first stunt element or the second stunt element is alignable with the track portion depending on the position of the selector;

a trigger engageable by a toy vehicle, the actuation of the trigger by the toy vehicle resulting in rotation of the selector from its first position to its second position.

2. The toy vehicle track set of claim 1, wherein the first path when the first entrance is aligned with the track portion is different than the second path when the second entrance is aligned with the track portion.

3. The toy vehicle track set of claim 1, wherein the second path includes a loop portion.

4. The toy vehicle track set of claim 1, wherein the trigger is actuated when a toy vehicle engages the trigger.

5. The toy vehicle track set of claim 1, wherein the first stunt element causes the toy vehicle to perform a first stunt, and the second stunt element causes the toy vehicle to perform a second stunt different from the first stunt.

6. The toy vehicle track set of claim 1, wherein the selector causes the toy vehicle to perform a plurality of vehicle stunts.

7. The toy vehicle track set of claim 1, wherein the second entrance is offset from the first entrance.

8. A toy vehicle track set, comprising:

a track portion; and a trigger engageable by a toy vehicle; and a selector rotatably mounted relative to the track portion, the selector being movable between a first position and a second position relative to the track portion in response to the actuation of the trigger, the selector including:

a first stunt element including a first entrance, the first stunt element being movable relative to the track portion and travelable by a toy vehicle when the selector is in its first position, the first entrance causing the toy vehicle to travel a first path on the track set, the first entrance being aligned with the track portion when the selector is in the first position and offset from the track portion when the selector is in the second position; and a second stunt element including a second entrance, the second stunt element being movable relative to the track portion and travelable by the toy vehicle when the selector is in its second position, the second entrance causing the toy vehicle to travel a second path on the track set, the second entrance being offset from the track portion when the selector is in the first position and aligned with the track portion when the selector is in the second position, wherein one of the first stunt element or the second stunt element is alignable with the track portion depending on the position of the selector.

9. The toy vehicle track set of claim 8, wherein the first path when the first entrance is aligned with the track portion is different than the second path when the second entrance is aligned with the track portion, at least one of the first path and the second path including a loop.

10. The toy vehicle track set of claim 8, wherein the first stunt element causes the toy vehicle to perform a first stunt, and the second stunt element causes the toy vehicle to perform a second stunt different from the first stunt.

11. The toy vehicle track set of claim 8, wherein the selector causes the toy vehicle to perform different vehicle stunts depending on the position of the selector relative to the track portion.

12. The toy vehicle track set of claim 1, wherein the second entrance is proximate to the first entrance.

13. A toy vehicle track set, comprising:

a track portion defining a track pathway;

a rotatable element proximate to the track portion, the rotatable element having a first stunt element and a second stunt element, the first stunt element having a first entrance and a first pathway, the second stunt element having a second entrance and a second pathway, the second entrance being next to the first entrance; and a stunt trigger proximate to the rotatable element, the stunt trigger being configured to be actuated by a toy vehicle, the actuation of the stunt trigger resulting in automatic rotation of the rotatable element from a first position in which the first entrance is aligned with the track pathway and the second entrance is laterally offset from the track pathway to a second position in which the first entrance is laterally offset from the track pathway and the second entrance is aligned with the track pathway.

14. The toy vehicle track set of claim 13, wherein the rotatable element has a third stunt element, the third stunt element having a third entrance and a third pathway, the third entrance being laterally offset from the first entrance and the second entrance.

15. The toy vehicle track set of claim 14, wherein the rotatable element moves from the second position to a third position in which the third entrance is aligned with the track pathway and both of the first entrance and the second entrance is offset from the track pathway.

16. The toy vehicle track set of claim 14, wherein the third entrance is next to the second entrance.

17. The toy vehicle track set of claim 14, wherein the second entrance is located between the first entrance and the third entrance.

18. The toy vehicle track set of claim 14, wherein the rotatable element moves to the second stunt element following a first actuation of the stunt trigger, and the rotatable element moves to the third stunt element following a second actuation of the stunt trigger.

* * * * *